United States Patent [19]

Walter

[11] 4,004,530

[45] Jan. 25, 1977

[54] METHOD FOR MAKING AN EASY OPENING END CLOSURE FOR A CONTAINER

[75] Inventor: John Walter, Evergreen Park, Ill.

[73] Assignee: Continental Can Company, Inc., New York, N.Y.

[22] Filed: Dec. 23, 1975

[21] Appl. No.: 643,647

Related U.S. Application Data

[62] Division of Ser. No. 365,014, May 29, 1973, Pat. No. 3,967,749.

[52] U.S. Cl. ..... 113/121 C; 113/121 A; 220/270; 220/359

[51] Int. Cl.[2] ..... B21D 51/44

[58] Field of Search .... 113/121 R, 121 A, 121 AB, 113/121 C, 121 E; 220/90.6, 256, 258, 270, 272, 352, 359

[56] References Cited

UNITED STATES PATENTS

| | | | |
|---|---|---|---|
| 3,160,325 | 12/1964 | Stull | 220/266 X |
| 3,184,096 | 5/1965 | Cheeley | 220/352 X |
| 3,302,824 | 2/1967 | Cheeley | 220/272 |
| 3,473,692 | 10/1969 | Moller | 220/90.6 X |
| 3,625,392 | 12/1971 | Kaminski | 113/121 A |
| 3,884,382 | 5/1975 | Ball | 113/121 A X |

*Primary Examiner*—Leon Gilden
*Attorney, Agent, or Firm*—Diller, Brown, Ramik & Wight

[57] ABSTRACT

The easy opening end closure for attachment to a can body. The end closure includes a plastic pull tab having a closure tab sealed in a slit which defines a displaceable closure.

The pull tab is attached by forging a plastic strip over a lid in a manner such that the plastic is caused to flow and force the metal panel against a cutting edge to form a slit defining a displaceable closure. At the same time the forged plastic flows beneath the adjacent edges of the slit to form a tight seal therein.

4 Claims, 11 Drawing Figures

FIG. 1
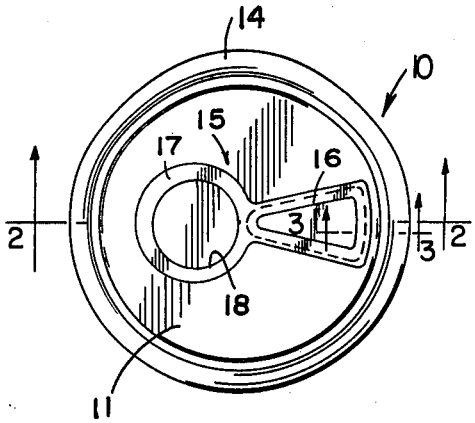
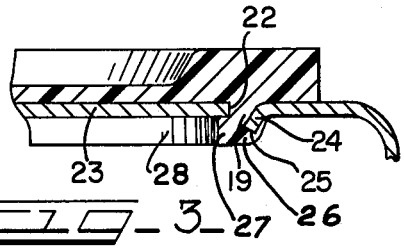
FIG. 3
FIG. 4
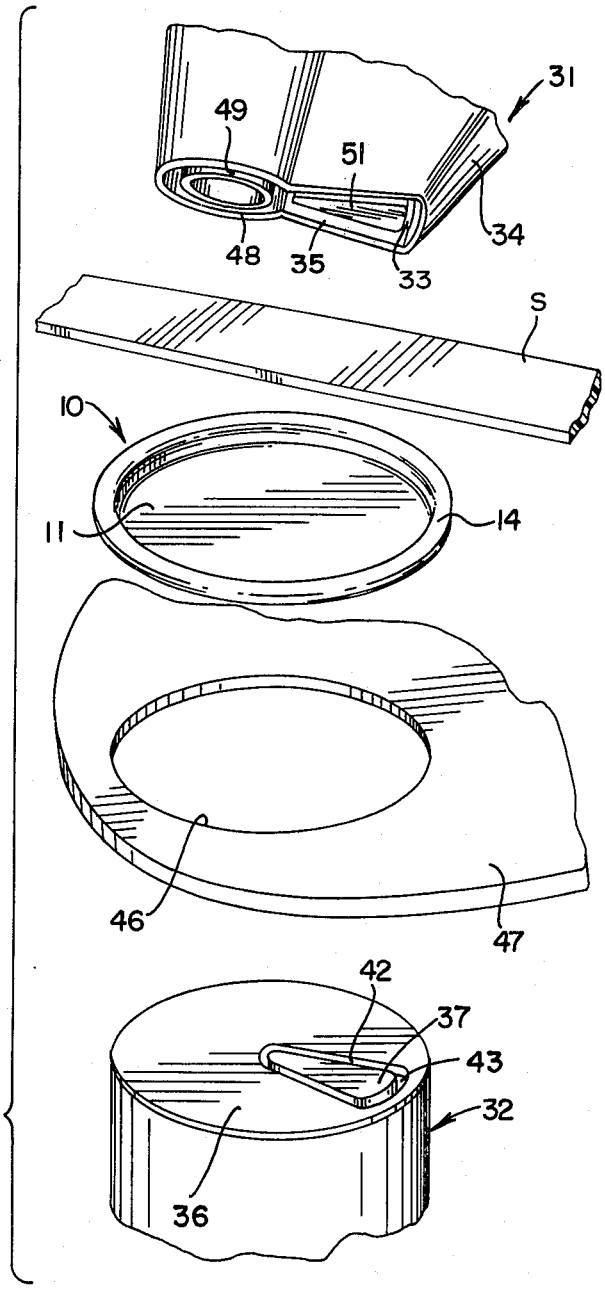
FIG. 2
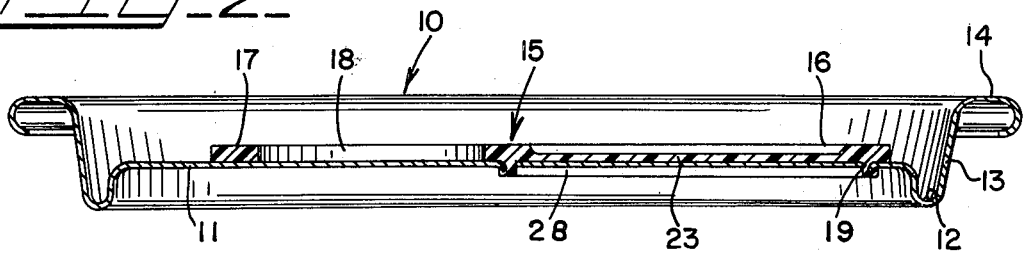

FIG. 7
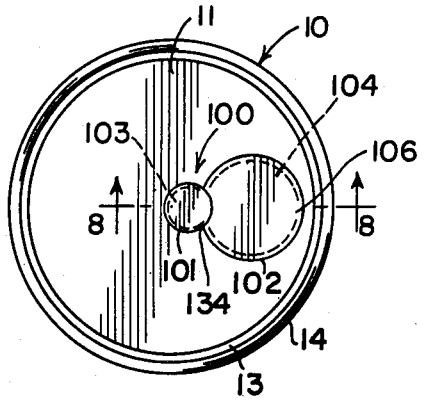
FIG. 11
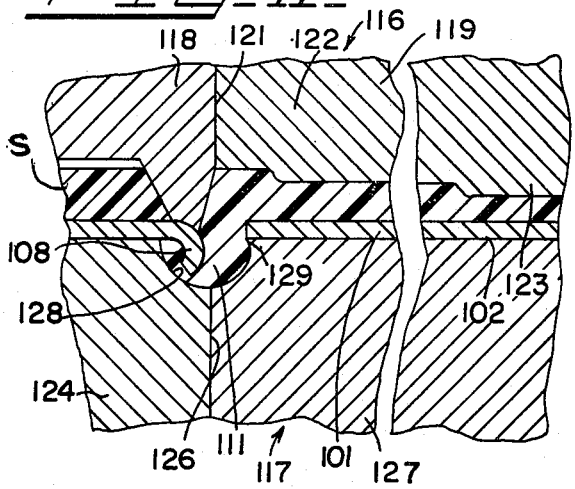
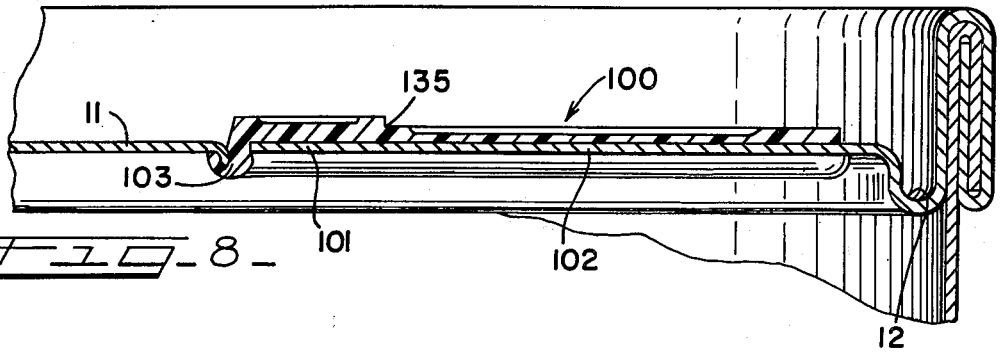
FIG. 8
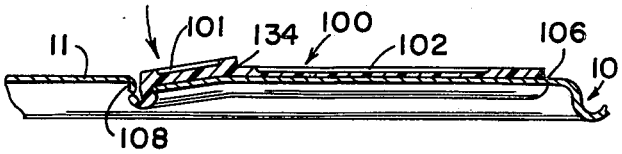
FIG. 9
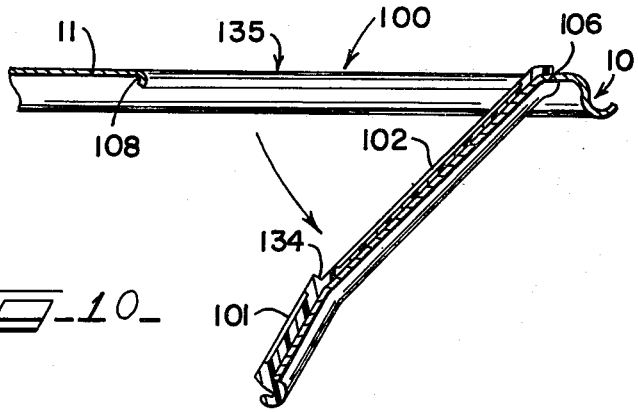
FIG. 10

METHOD FOR MAKING AN EASY OPENING END CLOSURE FOR A CONTAINER

This is a division of Ser. No. 365,014, filed May 29, 1973, now U.S. Pat. No. 3,976,749.

BACKGROUND AND SUMMARY OF THE INVENTION

The present invention relates to containers and more particularly to a new and novel easy opening end closure for a container and to the method for forming the same.

Heretofore it has been common practice to form easy opening end closures by scoring the end panel to define a removable panel portion. A metal tab for separating and removing the removable panel portion is attached to the latter by a rivet integral therewith.

By the present invention it is proposed to provide an easy opening end closure or unit for a container including a plastic tab which is fastened to the removable panel without requiring a rivet or the like. The plastic tab is attached to the panel of the end unit in a manner such that it separates a closure portion from the panel and forms a seal along its line of separation. The tab remains attached to the closure portion when the latter is displaced to provide a pour opening in the end closure.

The end closure of the present invention comprises generally a plastic strip overlying a metal panel and which is sealingly seated in a slit formed by forcing the plastic through the panel to cut the panel to define a closure portion. In one form of the invention the closure portion is defined by a continuous cut line or slit. The plastic strip is disposed in the slit and embraces the edges about the slit and the closure portion to retain the latter on the panel. The plastic strip includes a finger grip portion which overlies the panel. Upon gripping the finger grip portion and applying an upward pulling force, the plastic in the slit is separated from the edge on the panel and remains attached to the closure portion as the latter is separated from the panel to provide an opening. The slit is preferably formed so that the marginal edge portion of the panel bounding the opening is turned downwardly. Thus upon separation of the closure portion, the raw edge bounding the opening is not exposed. This reduces the possibility of injury by cutting or the like.

In another form of the invention the closure portion is defined by a discontinuous slit in which the plastic is embedded. The unslit portion serves as a hinge about which the closure portion may be turned to press it into the container.

The above described easy opening structures are constructed by a novel method comprising generally the steps of placing a strip of plastic in a die including a punch for blanking the strip of plastic material and a forging punch. The plastic strip is struck by the forging punch so as to displace and force the plastic against a sharp cutting edge to sever the panel and form a slit into which the plastic is embedded. The slit with the plastic embedded therein defines a closure portion which is displaced out of the plane of the panel to provide a pour opening in the panel.

BRIEF DESCRIPTION OF THE DRAWINGS

FIG. 1 is a top plan view of an easy opening end closure embodying the structure of the present invention.

FIG. 2 is an enlarged cross-sectional view taken generally along the lines 2—2 of FIG. 1.

FIG. 3 is a greatly enlarged cross-sectional view taken generally along the lines 3—3 of FIG. 1 and showing the plastic forged into the slit defining the closure portion.

FIG. 4 is an exploded view of the apparatus used to make the end unit shown in FIGS. 1–3 and showing the relationship with the plastic and the end unit shell.

FIG. 7 is a plan view of another embodiment of the invention.

FIG. 8 is an enlarged fragmentary cross-sectional view taken generally along the lines 8—8 of FIG. 7.

FIG. 9 is a fragmentary cross-sectional view similar to FIG. 8 but showing the pop disk opened.

FIG. 10 is a fragmentary cross-sectional view similar to FIGS. 8 and 9 but showing the closure in the open position.

FIG. 11 is a fragmentary cross-sectional view of the die components used to form the closure.

DESCRIPTION OF THE PREFERRED EMBODIMENT

Figure 6:
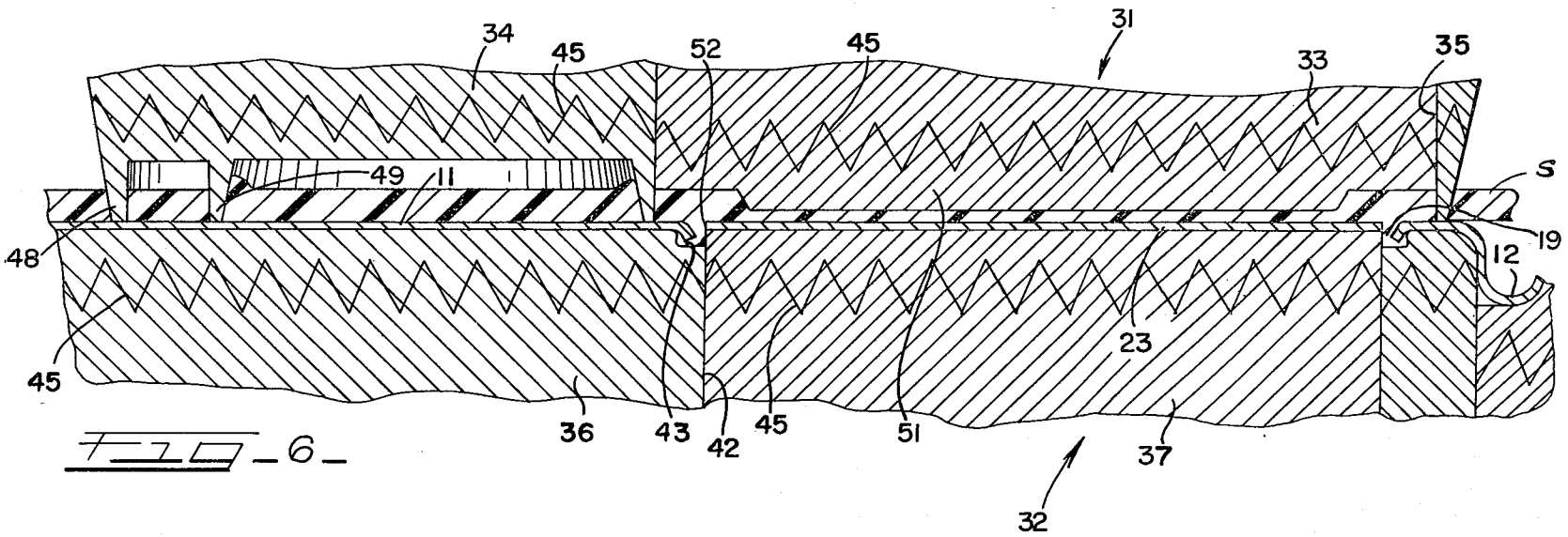
FIG. 6 is an enlarged fragmentary cross-sectional view similar to FIG. 5 but showing the forge punch in the fully closed position of the tooling.

Referring now to the drawings in particular FIGS. 1–3, there is shown one embodiment of an end unit or closure 10 embodying the easy opening structure of the present invention. The end unit 10 comprises generally a panel 11 having a peripheral bead 12 from which there projects an upstanding wall 13. The upstanding wall 13 terminates in a generally horizontally extending hook flange 14 by which the end is double seamed to a container body (not shown) in the conventional manner.

An easy opening tab 15 is attached on the panel 11 and includes a plastic strip having a closure portion 16 and a finger grip portion 17. The finger grip portion 17 is generally in the shape of a ring having an opening 18 into which the forefinger of the user may be inserted.

The closure portion 16 is attached to the panel so as to be squeezed into a slit 19 formed during the attachment of the plastic strip as more fully to be explained hereinafter. The plastic strip may be a material such as polyethylene, polypropolene or the like. The slit 19 defines a closure portion 23 having a sheared edge 22 along one side. Along the other side the slit 19 includes a downturned lip 24 on the panel 11 with the edge 25 facing downwardly and inwardly. The closure portion 16 is forged into the slit 19 so that a marginal portion 26 along one side underlies the lip 24 and a marginal portion 27 along the opposite side embraces the sheared edge of the closure portion 23.

Upon the application of an upwardly applied pulling force as by upward pulling on the finger grip portion 17, the marginal portion 26 disposed in the slit 19 is separated from the lip 24. The forged portion 27 embracing the edge 22 of the closure portion 23 remains attached thereto and serves to separate the closure portion 23 from the panel 11 to provide a pour opening 28 as further upward pulling is exerted on the pull tab 15.

It is to be noted that the pour opening 28 thus formed upon removal of the closure portion 23 is defined by the downwardly turned lip 24 so tat the raw edge 25 is not exposed. This reduces the possibility of cutting the lips in the event the user consumes the contents directly from the container. Moreover, the marginal edge of the removed closure portion 23 is also covered by the plastic which prevents injury by cutting or the like if it is carelessly discarded.

The easy opening closure may be formed in a press including a die having an upper member 31, a lower member 32, and a rotary dial support 47. The members 31 and 32 are reciprocable relatively to each other between an open and closed position.

Figure 5:
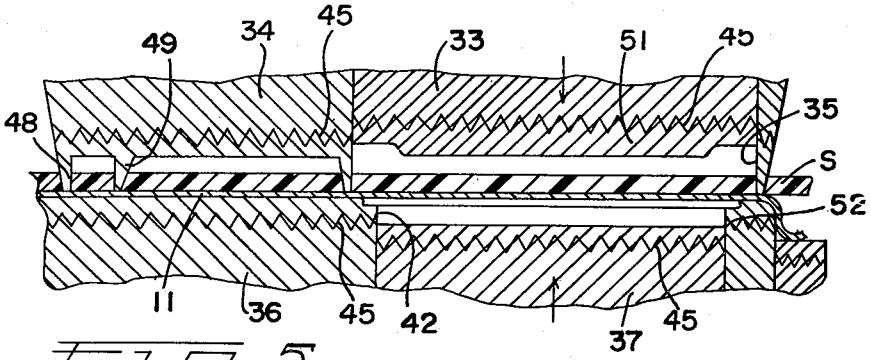
FIG. 5 is a fragmentary cross-sectional view taken through the apparatus as it blanks the pull tab from the plastic strip.

The upper member 31 includes, as shown in FIGS. 4, 5 and 6, a forge punch 33 disposed for relative vertical movement in a bore 35 provided in a blanking punch 34. The forge punch 33 is of a generally tear drop shape outlined to blank out the closure portion 23 and includes a projecting boss 51. The blanking punch 34 is shaped to cut the tab from a strip S of plastic material.

The lower member 32 includes a anvil 36 having an opening or bore 42 which slidably receives a blanking punch 37 for vertical movement therein. The opening is shaped similar to the bore 35 in the upper die member 31, but is of lesser crosssectional area so that the cutting edge 52 on the punch is spaced from the wall of the bore 35. The anvil 36 includes a peripheral groove 43 formed about the opening 42. The groove 42 is adapted to receive plastic displaced therein from a plastic strip S during the attachment of the tab 15 to the end unit 10 as to be explained below.

The upper and lower die members 31 and 32 and components may include electrical heating elements 45 which serve to heat the members 31 and 32 and maintain the plastic strip S disposed therebetween in a workable state if desired. It is to be understood, however, that the method of the present invention may be practiced by cold working of the plastic without heating.

Initially a plastic strip S is placed over the lid or end unit 10 which is retained in an opening 46 of the turret or dial 47. The plastic strip S may be heated prior to being fed over the lid 10 and also heated by the lower die member 32. The heated punch 33 including the blanking member 34 are lowered to a first closed position so that cutting edge 48 severs the pull tab from the strip "S" and the cutting edge 49 forms the finger opening 18.

In the second stage of the closing operation, the forge punch 33 and the blanking punch 37 are brought into engagement, whereupon the center projection or boss 51 is operative to apply a downward force on the plastic strip S. This causes the plastic to flow toward the groove 43 so that the panel is severed along the cutting edge 52 about the periphery of the blanking punch 37. At the same time, the metal disposed over the groove 43 is bent downwardly into an inclined position to form the lip 24. It is to be noted that as the plastic is forced into the groove 43, the plastic flows around the edge of the downwardly turned lip 24 and beneath the marginal portion of the closure portion 23. The plastic about the lip 24 thus serves to prevent the exposure of the cut edge 24 with the product in the container on which the end is adapted to be applied. Also the downturned edge 24 minimizes the danger of cutting particularly when the contents are directly consumed from the container.

Referring now to FIGS. 7–10 there is shown an end closure 10 incorporating another embodiment of easy opening structure 100. The easy opening structure 100 is formed in the panel 11 and includes a tab 105 made from a plastic material and including a pop disk 101 and larger closure disk or portion 102 which intersect and form in the nature of a figure eight having a restriction 134. The non-intersecting edge of the pop disk 101 is seated in a slit 103 formed by squeezing the plastic therein and the closure disk 102 also is seated in slit 104 formed similarly to the slit 103. The slits 103 and 104 form in the nature of a figure eight with an unslit portion 106 located opposite the slit 103. The unslit portion 106 defines a primary hinge line about which the closure tab 105 formed by the slits 103 and 104 is pivoted into the container as shown in FIG. 8 to provide a pour opening through which the contents of a container may be poured.

The slit 103 and slit 104 are defined on one side by cut edges 107 and along the opposite edges by downturned lips 108 so that the cut edges 109 face inwardly. As the plastic strip S is squeezed to form the slits 103 and 104, the plastic embraces the cut edge about the closure tab 100 and also underlies and curls about the cut edges 109 of the downturned lips 108 as shown to form sealing portions 111 which seal the slits.

The closure tab 100 may be formed prior to placing the plastic strip S between an upper die assembly 116 and lower die assembly 117. The die assemblies 116 and 117 are mounted in a press for movement between an open and closed position.

The upper die assembly 116 includes a blank punch 118 which serves to blank the intersecing pop disk 101 and closure disk 104 from the strip S. The strip may be pre-heated as also may be the upper and lower die members. However, it should be clearly understood that the plastic strip S may be cold worked without any pre-heating or heating of the die assemblies.

A forge punch 119 is slidably disposed in an opening or bore 121 of the blank punch 118. A circular projection or boss 122 concentric with the outline of the pop disk 101 is formed on the face of forge punch 119. Another circular projection or boss 123 concentric with the closure disk 102 projects a greater distance from the face of the forge punch 119 than the projection 122. The projection is cut-away along a chord line parallel to the unslit portion 106 so as to prevent severance of the panel in this area.

The lower die assembly 117 comprises a split die ring 124 having an opening 126. A slug or closure blank punch 127 is located in the opening 126. As shown in FIG. 11, the split die ring 124 if formed with a groove 128 located about the blank punch 127. In this connection it is to be noted that the blank punch 127 has a blanking or cutting edge 129 spaced inwardly of the periphery of the opening 121 that accommodates the forge punch 119. This provides a passage for the plastic material to flow as will be more fully explained hereinafter.

The upper and lower die assemblies 116 and 117 are closed with a strip of plastic material S disposed over the punch. The blank punch 118 is initially operative to blank out the intersecting pop disk 101 and closure disk 102. Thereafter, the forge punch 119 and the blank punch 127 are brought together with greater force. This causes the plastic between the projections 122 and 123 to be squeezed and flow outwardly and downwardly in the passage between the wall of the opening 121 and the cutting edge 129 with such force that the metal panel 11 is severed to form the disks 101 and 102. At the same time, the marginal edge portion of the panel 11 overlying the groove 128 is curled downwardly and inwardly to form the lip 108. The force applied is such that the plastic encapsulates the downwardly and inwardly curled lip 108. Also the plastic underlies the marginal cut edge of the metal pop disk 101 and the metal closure disk 102.

With the arrangement, as shown, having two intersection disks of different diameters, the narrow restriction 134 at the intersection is operative to prevent the disks 101 and 102 from becoming easily detached from the panel and forms in the nature of a hinge line.

To open the container, a pushing force is applied on the pop disk 101. This causes the plastic embracing the downwardly depending marginal portion or lip 108 to be detached, whereupon the disk 101 hinges about the narrow restriction 134 as shown in FIG. 9. This permits the container to be vented. Thereafter, a force is applied on the closure disk 102 to overcome the force at the restricted hinge line 134 and to break the remainder of the plastic embracing the lip 108 about the closure disk 102. The pop disk 101 and closure disk 102 are then free to hinge about the non detached portion 106 to the position shown in phantom in FIG. 10. An opening 135 through which the contents of the container may be poured is thus provided.

What is claimed is:

1. The method of forming an easy opening end closure in a metal panel comprising the steps of placing a strip of plastic material on said panel, placing said end closure on a blanking punch, appying sufficient force on said plastic to forge the plastic and cause the metal panel to be displaced toward said blanking punch and be severed by said forged plastic to form a slit, and allowing said forged plastic to fill said slit.

2. The method as defined in claim 1 further comprising the step of allowing the forged plastic to encapsulate the opposite edges bordering said slit.

3. The method as defined in claim 2 further comprising the step of causing the forged plastic to depress the marginal edge portion of the panel bordering said slit.

4. The method as defined in claim 3, comprising the further step of causing the forged plastic to depress the marginal edge portion of the panel bordering said slit.

* * * * *